United States Patent [19]

Argazzi

[11] Patent Number: 4,627,216

[45] Date of Patent: Dec. 9, 1986

[54] APPARATUS FOR THE POSITIVE TRANSFER OF TUBES FROM THE LINE WHICH PROCESSES THEM INTO BOXES OF TUBE-FILLING AND BOXING MACHINES

[75] Inventor: Ivo Argazzi, Pianoro Nuova, Italy

[73] Assignee: I.M.A.—Industria Macchine Automatiche—S.p.A., Ozzano Emilia, Italy

[21] Appl. No.: 749,876

[22] Filed: Jun. 27, 1985

[30] Foreign Application Priority Data

Aug. 3, 1984 [IT] Italy ..... 3555 A/84

[51] Int. Cl.[4] ..... B65B 5/04; B65B 7/14

[52] U.S. Cl. ..... 53/251; 53/573

[58] Field of Search ..... 53/251, 573, 571, 469, 53/373

[56] References Cited

U.S. PATENT DOCUMENTS 3,380,222 4/1968 Bergmann et al. ..... 53/469 X
3,592,003 7/1971 Stichhan ..... 53/251 X
4,320,615 3/1982 Gmür ..... 53/573 X
4,345,629 8/1982 Inglett, Jr. ..... 53/573 X

FOREIGN PATENT DOCUMENTS 592670 5/1959 Italy ..... 53/251

*Primary Examiner*—James F. Coan
*Attorney, Agent, or Firm*—Karl F. Ross; Herbert Dubno

[57] ABSTRACT

An apparatus for the positive transfer of pre-formed tubes of the so-called crushable type with open bases from the line which processes them into boxes of tube-filling and boxing machines comprises first gripper means which may be vertically moved in an alternating manner at the location of a station at which the tubes are taken up rhythmically from the processing line, second gripper means which may be moved vertically in an alternating manner at the location of a station for the rhythmic introduction of these tubes into the said pre-fabricated boxes having their filling apertures upwardly open and gripper means which may be moved in an alternating manner for the rhythmic transfer of the tubes from the first to the second gripper means.

1 Claim, 7 Drawing Figures

APPARATUS FOR THE POSITIVE TRANSFER OF TUBES FROM THE LINE WHICH PROCESSES THEM INTO BOXES OF TUBE-FILLING AND BOXING MACHINES

CROSS REFERENCE TO RELATED APPLICATIONS

This application is related to the commonly owned concurrently filed copending applications Ser. Nos. 749,878 and 749,879.

FIELD OF THE INVENTION

The present invention relates to an apparatus for the positive transfer of crushable tubes from a line which processes them into a box of a tube-filling and boxing machine.

The invention relates, more particularly, to an apparatus which is particularly designed for the positive transfer of pre-formed tubes of the so-called crushable type with their bases open from the line which processes them into boxes of a tube-filling and boxing machine.

BACKGROUND OF THE INVENTION

A tube-filling and boxing machine must be supplied from a supply hopper in which the horizontally disposed tubes are stored, in individual succession and in a positive manner with these tubes, to supply them so that they are in a vertical arrangement with their open bases facing upwardly resiliently acting take-up members of the processing line along which the tubes are moved in successive steps and are filled and have their bases sealed in a conventional manner. The tubes processed in this way, i.e. filled and with their bases sealed, are taken up, still in phase with the successive step feed along the processing line, rhythmically, by transfer members designed to insert them in respective prefabricated packaging boxes or containers having their filling apertures upwardly open, which members are displaced, still in a positive manner, in an identical rhythmic succession to a boxing station and are closed at this station inside the corresponding boxes with the subsequent closure of the filling aperture.

SUMMARY OF THE INVENTION

In the context of the positive transfer of the tubes in individual sequence from an initial take-up member to a subsequent take-up member so as to supply them from the processing line of the tube-filling section into boxes of the tube-filling and boxing machine, I have provided, in accordance with the present invention, a device having first gripper means which may be moved vertically in an alternating manner at the location of a station for the rhythmic take-up of the tubes from the processing line, second gripper means which may be vertically moved in an alternating manner at the location of a station for the rhythmic introduction of the tubes into the prefabricated boxes with their filling apertures upwardly open, and horizontal gripper means which may be moved in an alternating manner for the rhythmic transfer of the tubes from the first to the second gripper means.

The present invention therefore relates to a device for the positive supply of the preformed tubes of the so-called crushable type with their bases open from the processing line to the location where they are boxed in the tube-filling and boxing machine.

The processing line can comprise a plurality of uniformly spaced resilient take-up members preferably constituted by a member in the form of an upturned cup grooved longitudinally at the top.

The boxes are made up with their filling apertures upwardly open from tubular blanks which are folded flat with their respective panels superimposed in mutual contact taken rhythmically from the base of an inclined hopper or store containing them in a stacked arrangement.

According to the invention the transfer means comprises first gripper means which may be moved vertically with an alternating movement at a station for the rhythmic take-up of the tubes from the said processing line, second gripper means which may be moved vertically with an alternating movement at a station for the rhythmic introduction of the tubes into the boxes made up with their filling apertures upwardly open and horizontally movable gripper means which may be moved in an alternating manner for the rhythmic transfer of the tubes from the first gripper means to the second gripper means.

The first gripper means advantageously comprises two jaws supported in a movably coupled manner and counterrotating, a first system of articulated levers with the end of one of the levers rigidly pivoted on the axis of rotation of one of the counter-rotating jaws and the end of another of these levers held slidably in a vertical guide member associated with a lever of a second articulated lever system controlled by control means.

Advantageously the second gripper means comprises a fixed jaw and a movable jaw, the movable jaw having an arm held slidably by its free end in a vertical guide member associated with a corresponding articulated lever system controlled by respective control means.

The horizontally movable gripper means can be formed by arms shaped at their respective free ends as semi-circular jaws arranged in mirror image, control means being provided to actuate the arms and therefore to cause the opposite jaws to open and close independently at the take-up and insertion stations mentioned above.

BRIEF DESCRIPTION OF THE DRAWING

Further features and advantages of the apparatus of the invention will become apparent from the following description of a preferred practical embodiment thereof, given purely by way of non-limiting example with reference to the accompanying drawing, in which.

SPECIFIC DESCRIPTION

Figure 1:
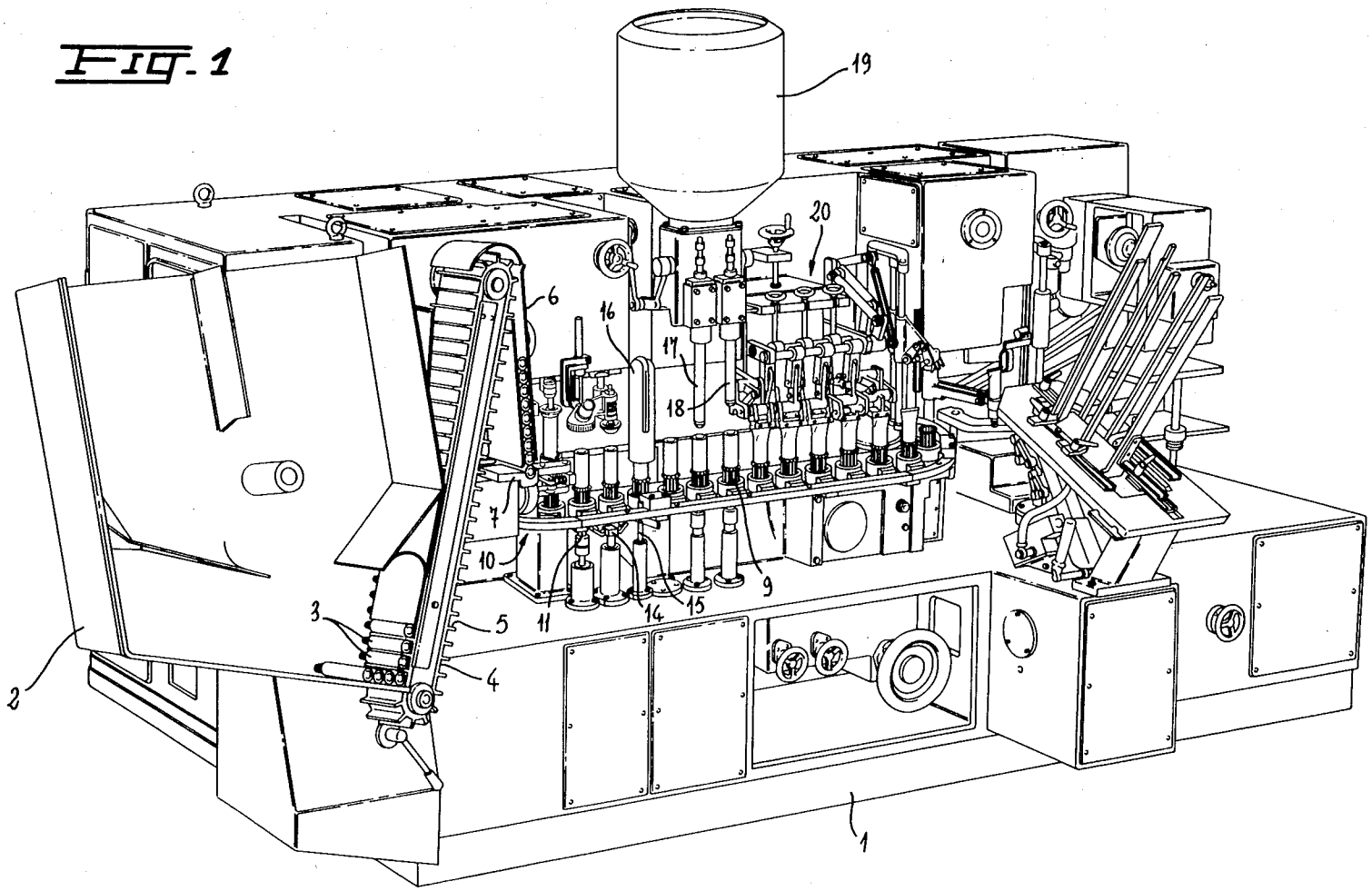
FIG. 1 is a partial front perspective view of a machine set using the device of the invention.

With reference to FIG. 1 which, as mentioned, shows an example of a possible practical embodiment of the tube-filling and boxing machine for the automation of this method in accordance with the above-mentioned patent applications, it can be seen that this machine comprises an elongate base 1 which supports at one end (the left-hand end of FIG. 1), a container hopper 2 in which preformed tubes 3 having open bases are horizontally disposed.

This hopper 2 has its base inclined towards the inner portion of the machine and its right-hand container wall in FIG. 1, i.e. towards the interior of the machine, is partially bounded, at the lower area towards the said base, by an endless conveyor 4 of the type having take-up sections or rackets 5 for successive individual tubes 3. This conveyor 4 having sections 5 is disposed in an upwardly inclined manner towards the interior of the machine and terminates at the top at the location of a slide duct 6 into which the tubes 3 taken up horizontally by the conveyor 4, are discharged.

This slide duct 6 is inclined in a mirror-symmetrical manner with respect to the sectional conveyor 4-5 and terminates at its base at the location of a rocker transfer member 7 for the tubes 3 which are supplied thereto in individual sequence from the slide duct 6. This rocker transfer member 7 has a horizontal reciprocating movement and may therefore transfer the tubes 3 in individual sequence and in a positive manner to a gripper element 8.

This gripper element 8, in addition to having a synchronized opening and closing movement of the jaws of the gripper for the purposes of gripping the horizontally disposed tubes 3 in the rocker of the corresponding transfer member 7, is also caused to oscillate in a rotary manner about a horizontal axis so as to be able to insert, still in individual sequence, the non-vertically disposed tubes 3 having their bases upwardly open, into resilient take-up means 9 associated with endless conveyor means 10 in a horizontal plane, provided with a stepped movement and forming the processing line of the tube-filling section of the machine.

The vertically disposed tubes with their bases upwardly open are displaced along this processing line in such a way that they pause at successive operating stations such as, for example, a station for checking the presence of a closure stopper at the opposite end and for tightening the latter with means 11, for cleaning of the tube using a blowing and suction device 12, for centering the print using movable upper means 13 and rotary gripper means 14, and for the ejection of defective tubes by means of ejector means 15 via a reverse discharge duct 16 of the machine. The tubes are then moved further along the processing line and are caused to pause at stations for filling in two successive stages via the corresponding upwardly open base using means 17 and 18 associated with a container 19 for the paste product, and for the sealed closure of this base by means, for example, folding means 20, for sealing the end zone by flattening of this zone of the tubes to form their bases.

At this point gripper means 21 take the closed and sealed tubes from this processing line and transfer them into a respective box having its filling aperture upwardly open. In the specific case shown in FIG. 1, the boxes are erected with their filling apertures open by taking blanks from a blank store 22. After the simultaneous supply and insertion of leaflets containing instructions for the use of the product into the boxes, these boxes are supplied to the box closure line of the boxing section of the machine, along which the closure of the filling apertures is carried out.

As mentioned above, the present invention relates to a device for the positive supply of preformed tubes of the so-called crushable type having open bases processed along the processing line of the tube-filling section of the tube-filling and boxing machines from this processing line into boxes supplied made up with their filling apertures upwardly open to the input of the boxing section of the tube-filling and boxing machine.

Figure 2:
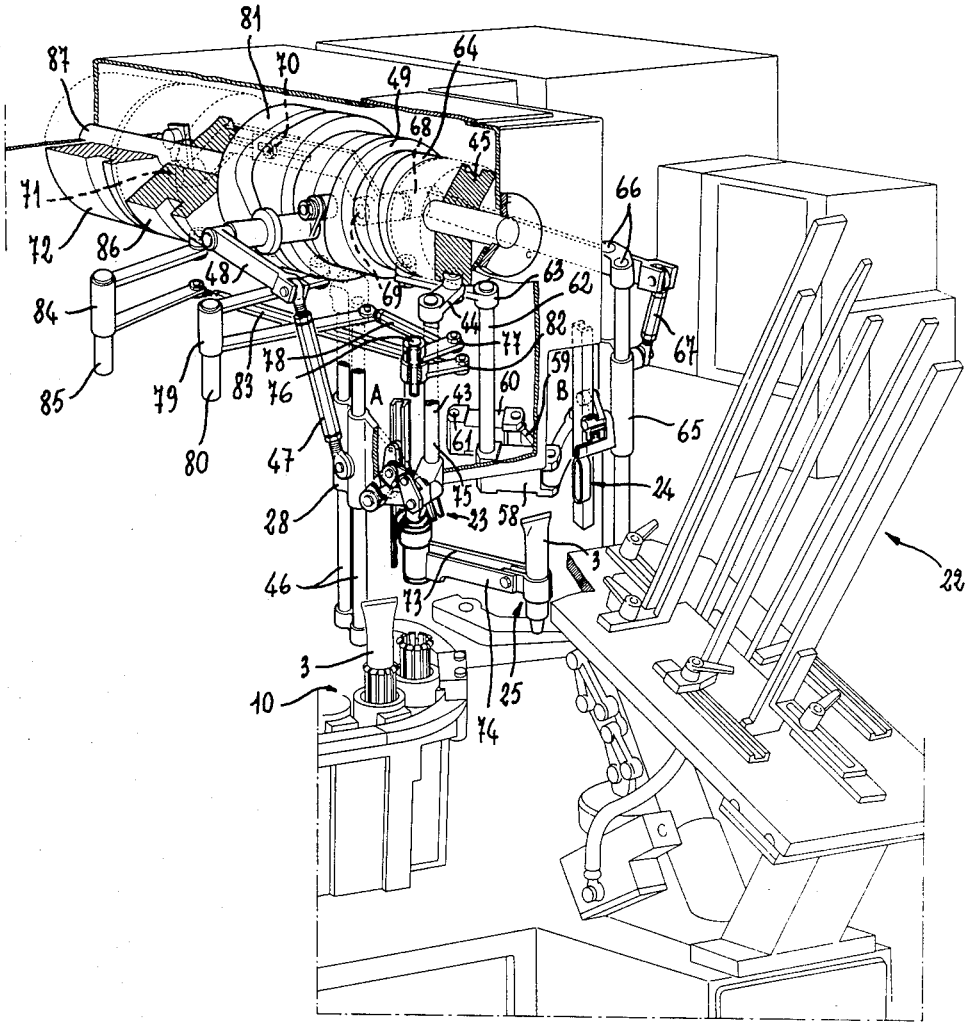
FIG. 2 is a perspective view of the device of the invention, with some components in cross-section and others removed so as to show further components.
Figure 4:
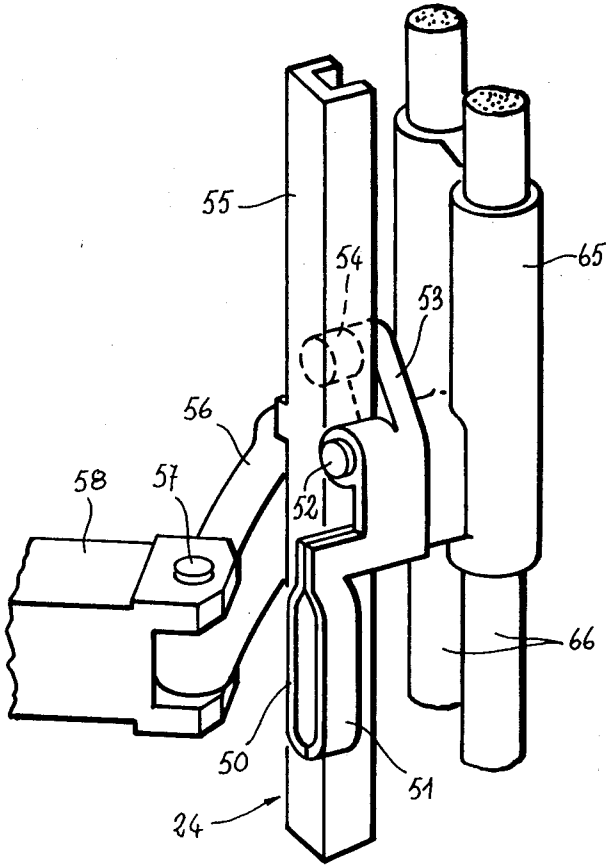
FIGS. 3 and 4 are perspective views of two details on an enlarged scale.

This apparatus shown in particular in FIG. 2 is essentially formed in accordance with the invention by first gripper means, shown overall by 23, disposed vertically and moving with an alternating movement, as will be explained below in detail, at a station A for the rhythmic take-up of the tubes 3 from the processing line 3 for the tubes, by second gripper means shown overall by 24, disposed vertically and moving with an alternate movement, as will be explained below in detail, at a station B for the rhythmic insertion, also explained below, of the tubes 3 into boxes made up with their filling apertures upwardly open, and by gripper means, shown overall by 25, disposed between the two stations A and B and moving horizontally in an alternating manner for the rhythmic transfer, as will be explained below, of the tubes 3 from the first gripper means 23 to the second gripper means 24, or from the take-up station A to the insertion station B.

Figure 3:
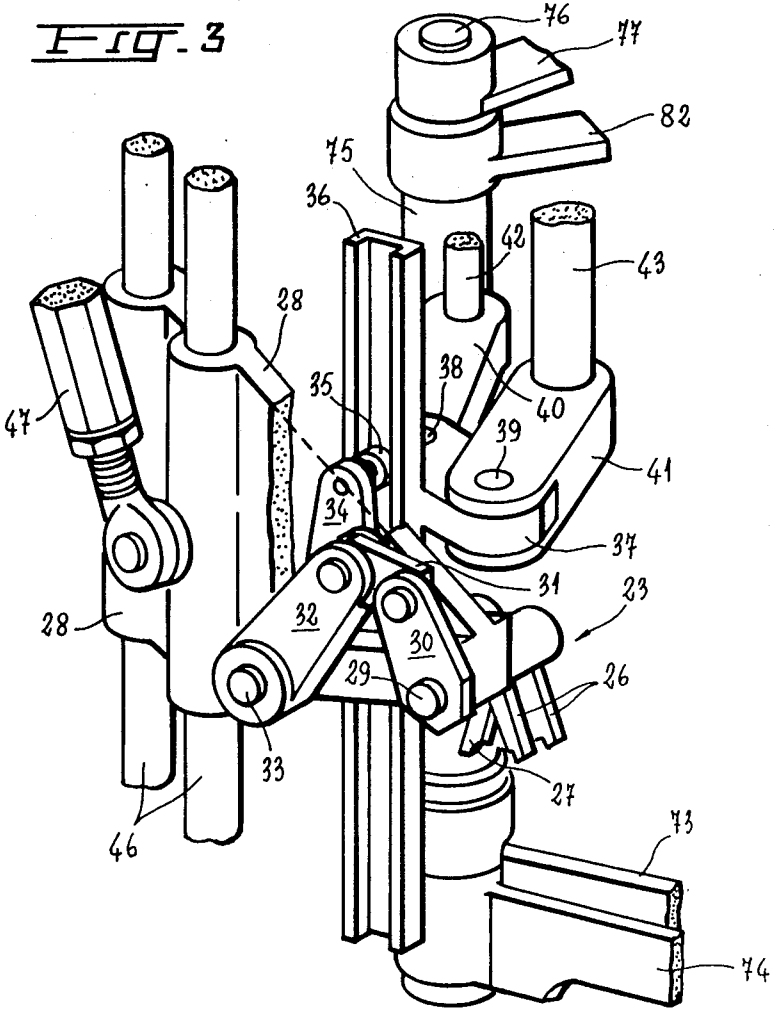

These first gripper meas 23 comprise (see FIG. 3 in particular) two pairs of jaws 26 and 27 supported on a support element 28 and coupled movably such that they counter-rotate (not shown in the drawings), with the pair of jaws 26 keyed on the pin 29. The end of a lever 30 is keyed on this pin 29, the other end of this lever having articulated on it the end of a lever 31 whose other end is articulated on the end of a further lever 32 in turn keyed with its other end on the end of a pin 33 supported by the above-mentioned support element 28. The other end of this pin 33 has keyed on it the end of a further lever 34 supporting at its other end a cam follower idler roller 35 engaged slidably in the cavity of a C-shaped vertical guide element 36. The vertical guide element 36 is formed with a projection 37 on which there are articulated at 38 and 39 the respective ends of two connecting rods 40 and 41. The other end of the rod 40 is pivoted by a pin 42 at a fixed point of the base 1 of the machine, while the other end of the rod 42 is rigidly connected with a spindle 43 on whose other end there is keyed the end of a lever 44 supporting at its opposite end a cam follower idler roller engaged in the actuation throat of a control cam 45 (see FIGS. 2 and 3). The projection 37 of the vertical guide element 36, the rods 40 and 41 articulated on the projection 37 at 38 and 39, the pivot formed by the pin 42 and the spindle 43 form an articulated system controlled by the cam 45 for actuation by means of the horizontal displacement in both directions of the vertical guide element 36 for the opening and closure of the jaws 26 and 27. This articulated system, as mentioned above, is supported by the support element 28 which is in turn supported such that it moves in a vertical and alternating manner along two rods 46 via a connecting rod 47 and a lever 48 provided with a cam follower idler roller engaged in the actuation throat of a control cam 49.

The second gripper means 24 comprise a fixed jaw 50 and a movable jaw 51 oscillating, as will be shown below, about a horizontal pin 52. The movable jaw 51 is provided with an arm 53 having at its free end an idler roller 54 engaged slidably in the cavity of a C-shaped vertical guide element 55 which may be moved horizontally in both directions for the opening and closure of the movable jaw 51. This vertical guide element 55 is connected with the end of an arm 56 whose other end is articulated at 57 on one end of an element 58 forming part of an articulated system for the actuation of the movable jaw 51 also comprising the elements 59 and 60. This latter element 60 is pivoted at 61 on a fixed point of the machine, whilst the element 58 supports a vertical spindle 62 having fixed to its upper end the end of a lever 63 supporting at its other end a cam follower idler roller engaged in the actuation throat of a control cam 64. The fixed jaw 50 is rigid with a support element 65 mounted slidably and moving vertically in an alternating manner on two rods 66 (see FIG. 2). This support element 65 is connected to a connecting rod 67 which is in turn connected to an arm of a two-armed lever 68 oscillating about a horizontal axis 69. The other arm of this two-armed lever 68 is articulated at 70 in the form of a knee joint with one of the two arms of a second two-armed lever 71 supporting at the free end of its other arm a cam follower idler wheel engaged in an actuation throat of a control cam 72.

The horizontally movable gripper means 25 are formed by two horizontal arms 73 and 74 shaped at their respective free ends as semicircular jaws arranged in mirror image (see FIG. 2). The arm 73 is fixed on the lower end of a tube 75 supported rotatably in a vertical position whilst the arm 74 is fixed on the lower end of a spindle 76 disposed coaxially and slidably in the vertical tube 75. The other end of the spindle 76 is fixed to the end of a lever 77 whose other end is articulated on a connecting rod 78 for connection to one of the arms of a two-armed lever 79 oscillating about a vertical axis 80 and having at the free end of its other arm a cam follower idler roller engaged in the actuation throat of a control cam 81. At the upper end of the tube 75 there is fixed the end of a lever 82 on whose other end there is articulated a connecting rod 83 for connection to one of the arms of a two-armed lever 84 oscillating about a vertical axis 85 and having at the free end of its other arm a cam follower idler wheel engaged in the actuation throat of a control cam 86.

Figure 5:
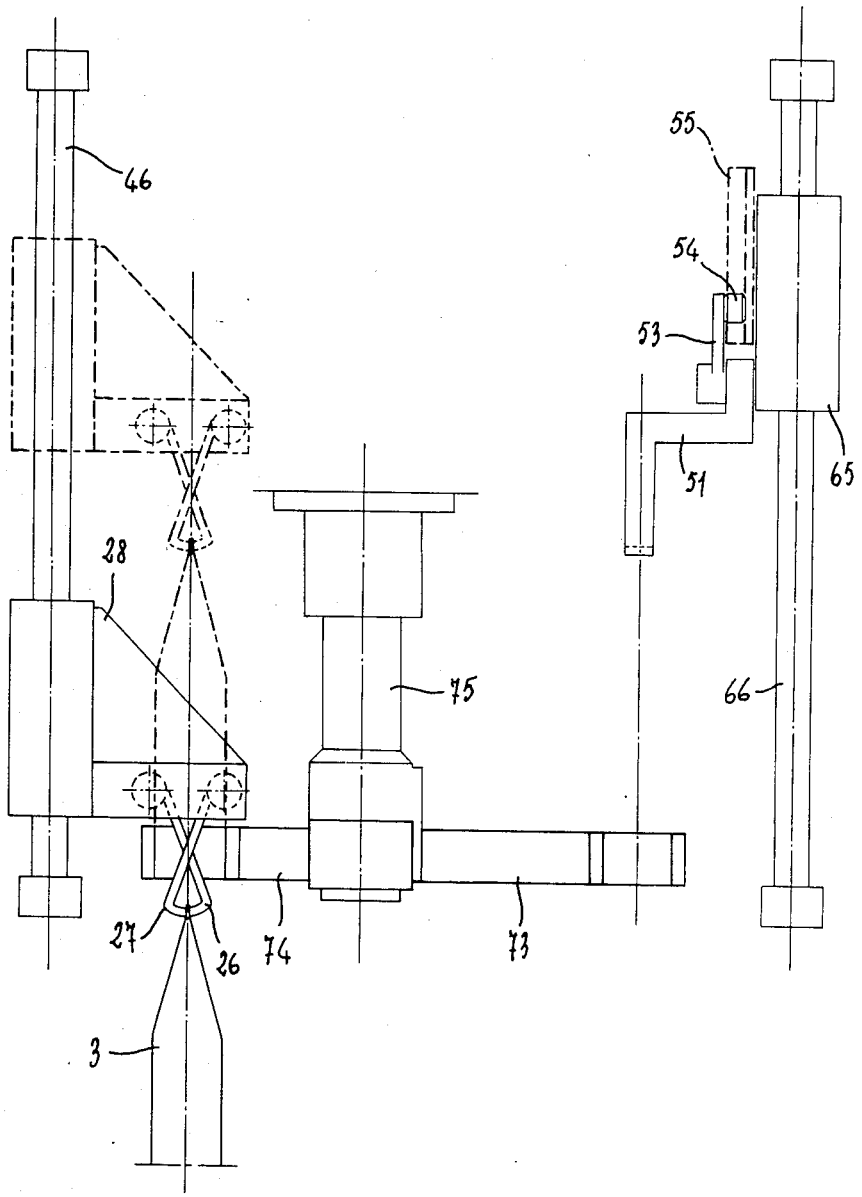
FIGS. 5, 6 and 7 are operational diagrams during three different stages of operation of the apparatus.
Figure 6:
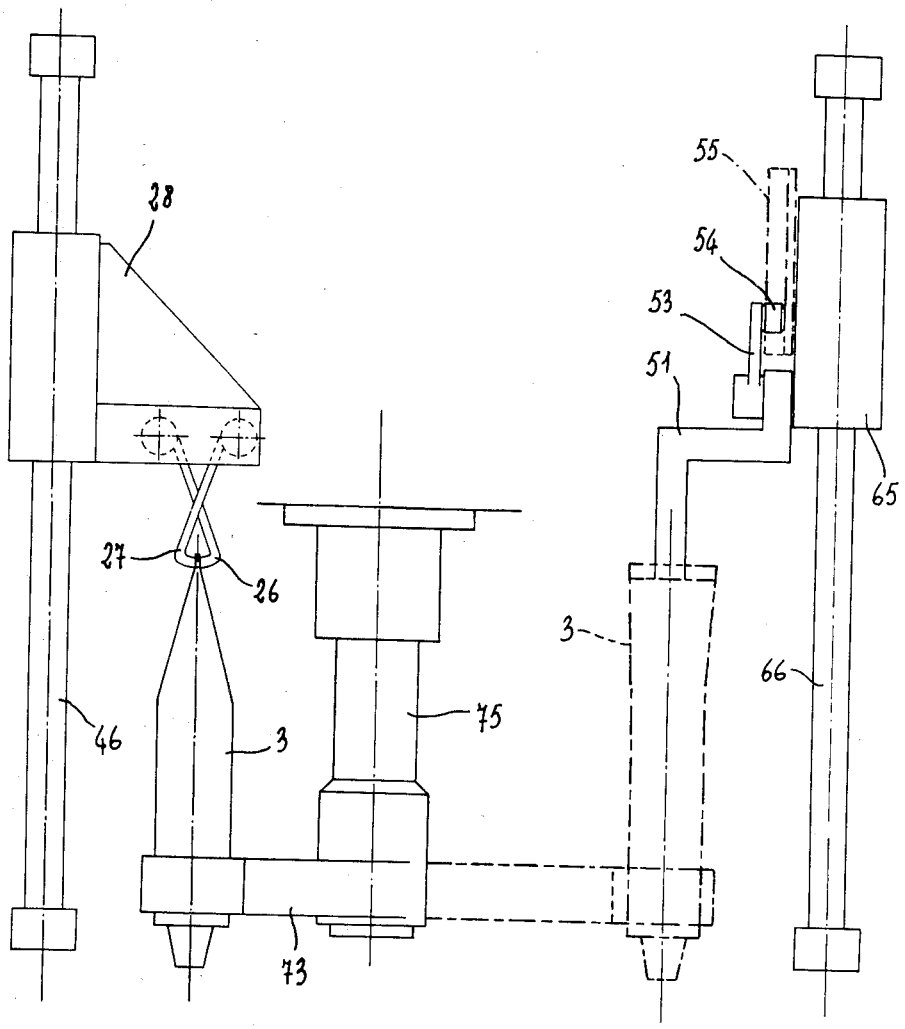
Figure 7:
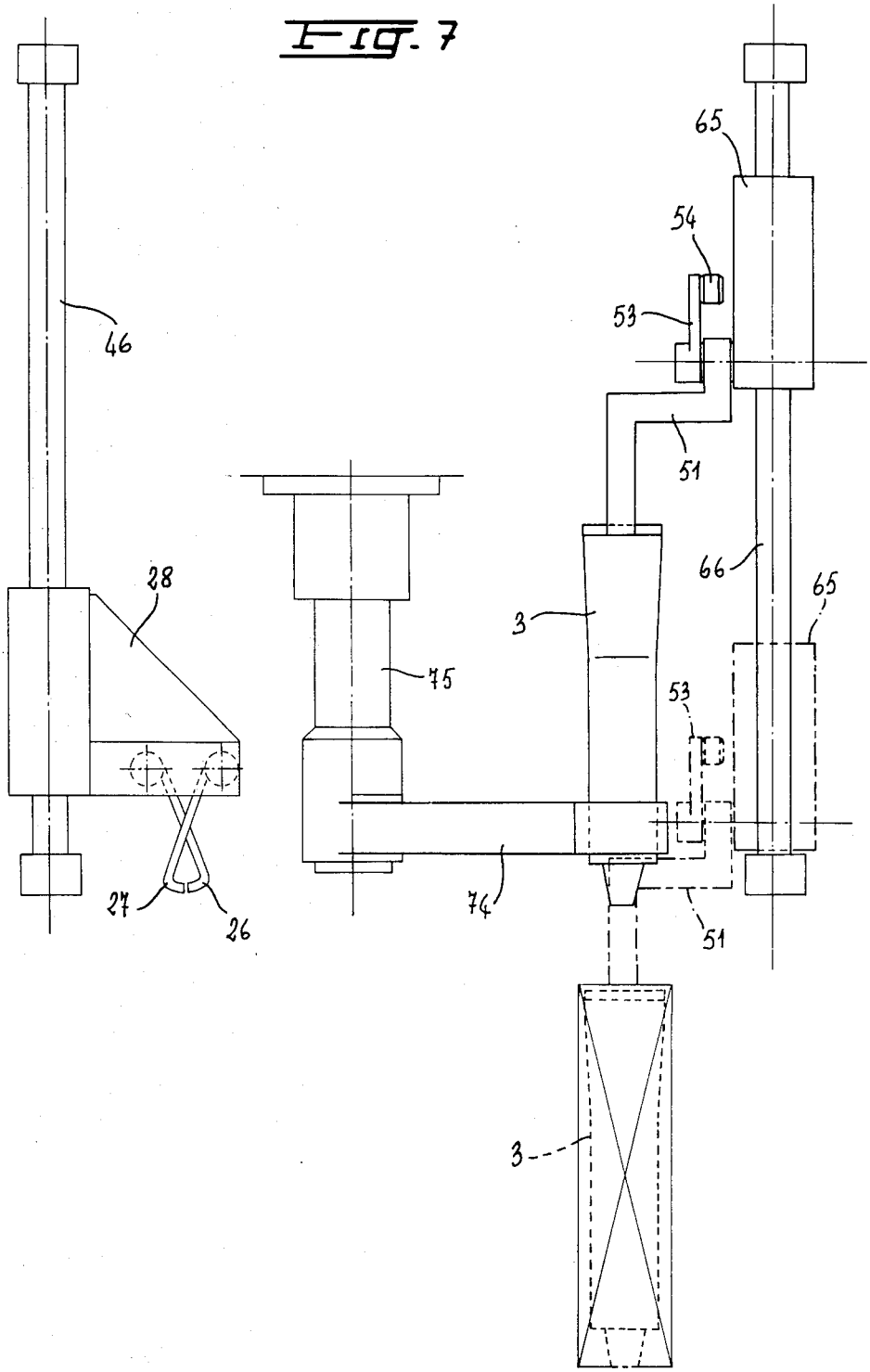

The cams 45, 49, 64, 72, 81 and 86 are all keyed in phase on a single shaft 87 controlled in a manner which is not shown by the mechanism of the machine. Consequently, when this shaft 87, and therefore the cams 45, 49, 64, 72, 81 and 86, rotate, it is possible to transfer in individual sequence, the tubes 3 closed and sealed at the station A of the processing line by means of their take-up by the jaws 26 and 27 of the gripper means 23 which take them from the processing line 10 (see FIG. 5) and supply them to the gripper means 25 (see FIG. 6) which rotate through 180° and transfer them below the gripper means 24 which take them up (see upper portion of FIG. 7) and insert them into made up boxes (see lower portion of FIG. 7) caused to arrive in phase synchronism to the boxing station B.

These made up boxes could for example be made up in accordance with the further patent application in the name of the applicants with their filling apertures upwardly open by taking the blanks from the store 22 and introducing the tubes into these boxes via the open aperture with the simultaneous insertion of instruction leaflets for the product by means of a known funnel mechanism called a hopper (not shown).

The description of this apparatus made with reference to the drawings is obviously given purely by way of non-limiting example and it is evident that any modifications or variants suggested in practice or by its use may be made thereto as long as they do not depart from the scope of the attached claims.

What is claimed is:

1. An apparatus for the positive supply of preformed crushable tubes which are filled with their bases open from a processing line to boxes in a tube-filling and boxing machine, the said processing line comprising a plurality of uniformly spaced resilient take-up members and the boxes being supplied made up with their filling apertures upwardly open from tubular blanks which are folded flat with their respective panels superimposed in mutual contact and taken rhythmically from the base of an inclined store containing them in a stacked said arrangement, said apparatus comprising first gripper means which can be moved vertically with an alternating movement for the rhythmic take-up of the tubes from the said processing line, second gripper means movable vertically in alternating manner for the rhythmic insertion of these tubes into boxes made up with their filling apertures upwardly open, and further gripper means moving horizontally for the rhythmic transfer of the tubes from the first to the second gripper means, said first gripper means comprising two jaws supported and coupled such that said jaws can be moved in counter-rotation, a first system of articulated levers with an end of one of the levers pivoted rigidly on the axis of rotation of one of said jaws and an end of the other of said levers held slidably in a vertical guide element asociated with a lever of a second articulated lever system controlled by control means;

said second gripper means comprising a fixed jaw and a movable jaw, the movable jaw of said second gripper means having an arm held slidably by a free end thereof in a vertical guide element associated with a corresponding articulated lever system controlled by respective control means; and said further gripper means being formed by arms shaped at their respective free ends as semicircular jaws arranged in mirror image and provided with control means for the actuation of the arms of said further gripper means and therefore of the jaws thereof, said control means of said first, second and further gripper means being coordinated for the takeup and insertion of said tubes.

* * * * *